US006401611B1

(12) United States Patent
Gunschera

(10) Patent No.: US 6,401,611 B1
(45) Date of Patent: Jun. 11, 2002

(54) DELIVERY OF A SHEET-PROCESSING MACHINE

(75) Inventor: Frank Gunschera, Nussloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/454,199

(22) Filed: Dec. 3, 1999

(30) Foreign Application Priority Data

Dec. 3, 1998 (DE) ..... 198 55 713

(51) Int. Cl.[7] ..... B41F 13/24
(52) U.S. Cl. ..... 101/232; 101/419
(58) Field of Search ..... 101/232, 231, 101/229, 220, 219, 419, 216, 408, 420

(56) References Cited

U.S. PATENT DOCUMENTS

| | | | | |
|---|---|---|---|---|
| 3,986,455 A | | 10/1976 | Jeschke et al. | 101/409 |
| 4,836,104 A | * | 6/1989 | Duarte | 101/420 |
| 4,919,048 A | * | 4/1990 | Tyler | 101/420 |
| 5,456,178 A | | 10/1995 | Henn et al. | 101/407.1 |
| 5,599,013 A | * | 2/1997 | Detmers et al. | 101/420 |
| 5,626,075 A | | 5/1997 | Detmers et al. | 101/232 |

FOREIGN PATENT DOCUMENTS

| | | | | |
|---|---|---|---|---|
| DE | 2017417 | | 7/1972 | |
| DE | 2354418 | | 4/1980 | |
| DE | 39 39 209 A1 | | 6/1990 | |
| EP | 0706882 A1 | | 4/1996 | |
| GB | 1464165 | | 2/1977 | |
| GB | 2169243 | * | 7/1986 | 101/226 |

* cited by examiner

*Primary Examiner*—Leslie J. Evanisko
*Assistant Examiner*—Anthony H. Nguyen
(74) *Attorney, Agent, or Firm*—Laurence A. Greenberg; Werner H. Stemer; Ralph E. Locher

(57) ABSTRACT

A delivery of a sheet-processing machine having gripper rows for drawing sheets, during operation, along a conveying section having endless conveying chains bearing the gripper rows and, during operation, running through the delivery in a revolving direction, and having a pair of chain wheels which are rotatable about a common axis of rotation, are in engagement with the conveying chains and form a deflecting region of the conveying section, includes a blast-air source for expelling an air curtain actable upon a side of the sheets being drawn past the sheet-deflecting region, that side being directed towards the axis of rotation of the chain wheels, the air curtain being movable past the sheet-deflecting region in the same direction as the grippers, while the sheets passing the sheet-deflecting region are being subjected to the action of the air curtain.

9 Claims, 4 Drawing Sheets

DELIVERY OF A SHEET-PROCESSING MACHINE

BACKGROUND OF THE INVENTION

Field of the Invention

The invention relates to a delivery of a sheet-processing machine, in particular, a printing machine, having gripper rows for drawing the sheets, during operation, along a conveying section having endless conveying chains bearing the gripper rows and, during operation, running through the delivery in a revolving direction, having a pair of chain wheels which are rotatable about a common axis of rotation, are in engagement with the conveying chains and form a deflecting region of the conveying section, and having a blast-air source for expelling an air curtain actable upon a side of the sheets being drawn past the sheet-deflecting region, that side being directed towards the axis of rotation of the chain wheels.

Such a delivery has become known heretofore, for example, from U.S. Pat. No. 5,456,178 which discloses an air curtain that is expelled by a blast-tube arrangement coordinated with surroundings of a transfer region wherein a respective gripper row receives a respective sheet from a sheet-guiding cylinder. Once the trailing end of a respective sheet leaves the transfer region, the sheet can then be subjected from this end, i.e., in the sheet travel direction, to blowing action from below. This has extremely adverse effects upon the smooth running or travel of the sheet, however.

In the case of relatively flexurally rigid sheets, in particular, cardboard or pasteboard, the conventional blast-tube arrangement does not provide the desired effect of preventing the sheet from striking randomly against machine parts. Quite contrarily, such a sheet would tend to collide with the conventional blast-tube arrangement.

The published German Prosecuted Patent Application (DE-AS) 20 17 417 discloses a drum provided with a gripper row that receives a sheet from an impression cylinder of a printing unit and transfers it to a following printing unit of a rotary printing machine of unit construction. For reasons not further specified, this drum has a jacket or casing that supports the sheet only along part of the extent thereof in the circumferential direction of the drum. A supporting device that supports the sheet pneumatically is provided in a space located between the sheet-supporting jacket and the gripper row, and covered by the sheets. According to an exemplary embodiment, the supporting device includes a blast tube that extends parallel to the drum axis, is disposed in the vicinity of an envelope positioned on the drum, has blow-out openings which are directed radially outwardly relative to the drum axis and circulates with the drum. This supporting device serves to prevent the formation of a curl in the sheet, the curl formation coming into abutting contact with the blanket cylinder of a respective printing unit as the sheet runs out of the nip, and further to counteract differences in register.

In the case of a delivery such as is mentioned in the introduction hereto, the problem involving the avoidance of differences in register does not arise. Rather, in such a case, there arises the general problem of transferring printed sheets to a sheet conveyor, and combining them into a pile or stack, without smearing. One of the conditions that has to be satisfied in this context is the smooth running or travel of the sheets.

SUMMARY OF THE INVENTION

It is accordingly an object of the invention to provide a delivery of the type mentioned in the introduction hereto so as to counteract the blast-air curtain adversely affecting the smooth travel of the sheets passing the sheet-deflecting region.

With the foregoing and other objects in view, there is provided, in accordance with one aspect of the invention, a delivery of a sheet-processing machine having gripper rows for drawing sheets, during operation, along a conveying section having endless conveying chains bearing the gripper rows and, during operation, running through the delivery in a revolving direction, and having a pair of chain wheels which are rotatable about a common axis of rotation, are in engagement with the conveying chains and form a deflecting region of the conveying section, comprising a blast-air source for expelling an air curtain actable upon a side of the sheets being drawn past the sheet-deflecting region, that side being directed towards the axis of rotation of the chain wheels, the air curtain being movable past the sheet-deflecting region in the same direction as the grippers, while the sheets passing the sheet-deflecting region are being subjected to the action of the air curtain.

In accordance with another feature of the invention, the air curtain is movable past the sheet-deflecting region synchronously with the grippers.

In accordance with a further feature of the invention, the air curtain is directable in a blowing direction with a tendency counter to the running direction of the sheets passing the sheet-deflecting region.

In accordance with an added feature of the invention, the blowing direction of the air curtain is adjustable.

In accordance with an additional feature of the invention, the air curtain is movable past the sheet-deflecting region at an adjustable distance from the conveying section.

In accordance with yet another feature of the invention, the air curtain is movable past the sheet-deflecting region at an adjustable phase angle relative to the grippers.

In accordance with yet a further feature of the invention, the delivery includes a drum body for carrying the blast-air source, and comprises a journal formed with-a cavity and received in a bearing bore of a side wall, the blast-air source being in communication with the cavity, the cavity being in communication with the bearing bore, and the bearing bore being connectable to a compressed-air generator.

In accordance with yet an added feature of the invention, the blast-air source is capable of expelling the air curtain cyclically.

In accordance with another aspect of the invention, there is provided a sheet-processing printing machine, comprising a delivery including at least one of the foregoing features.

In accordance with a concomitant feature of the invention, the sheet-processing machine is a printing machine.

Thus, in order to achieve the object of the invention, the blast-air curtain passes the sheet-deflecting region in the same direction as that of the conveying chains, while the sheets passing the sheet-deflecting region are subjected to the action of the blast-air curtain.

Such a configuration of a delivery avoids, in particular, the situation explained hereinabove wherein the trailing region of the respective sheet is subjected to blowing action from beneath. The reason therefor is that, in particular, in the case of the not absolutely necessary but nevertheless advantageously provided correspondence between the angular speeds of the grippers passing the sheet-deflecting region, on the one hand, and of the blast-air curtain passing the sheet-deflecting region, on the other hand, there is no change in the position of the blast-air curtain relative to the grippers and thus relative to the sheets, which are drawn by the grippers, within the sheet-deflecting region.

An advantageous configuration provides for the blowing direction of the blast-air curtain to be with a tendency counter to the running direction of the sheets passing the sheet-deflecting region, i.e., the blowing direction has a component that is directed counter to the running or travel direction of the conveying chains passing the deflecting region. This makes it possible, in the case wherein the blast-air curtain preferably making contact in a region of a sheet that directly adjoins the grippers drawing the sheet, for the sheet to be subject to the action of blowing or blast air over virtually the entire extent thereof, in the running direction of the sheet, without requiring the blast-air curtain to have, before it makes contact with the sheet, an extent that corresponds largely to the extent of the sheet in the running direction thereof. The blast-air source may thus be of correspondingly small construction, with the result that it may favorably be formed by just one nozzle row arranged transversely to the running direction.

Further preferred configurations provide that the blowing direction of the blast-air curtain be adjustable, that the blast-air curtain passes the sheet-deflecting region at an adjustable distance from the conveying section, and that the blast-air curtain passes the sheet-deflecting region at an adjustable phase angle relative to the grippers.

Utilizing at least one of these conditions, or else a combination of one of these conditions with at least one other, makes it possible for the action which supports sheets passing the sheet-deflecting region to be adapted to a relatively wide range of grammages and degrees of rigidity or stiffness of the sheets, and to different formats thereof, without having to modify the blast-air curtain with respect to the pneumatic parameters thereof. Accordingly, the outlay necessary for producing the blast-air curtain remains relatively low.

A further configuration preferably provides for the blast-air source to expel the blast-air curtain cyclically. Accordingly, the operation of expelling the blast-air curtain can be restricted to a period of time wherein the blast-air curtain passes the sheet-deflecting region in the same direction as the grippers, with the result that it is possible to avoid, in the surroundings of the conveyed sheets, possibly undesired flow states which occur outside the sheet-deflecting region.

Other features which are considered as characteristic for the invention are set forth in the appended claims.

Although the invention is illustrated and described herein as embodied in a delivery of a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 2 is an enlarged fragmentary view, partly broken away and partly in section, of FIG. 1, showing the structural unit formed of the chain-wheel pair and the blast-air source cooperating with the gripper rows;

DESCRIPTION OF THE PREFERRED EMBODIMENTS

Figure 1:
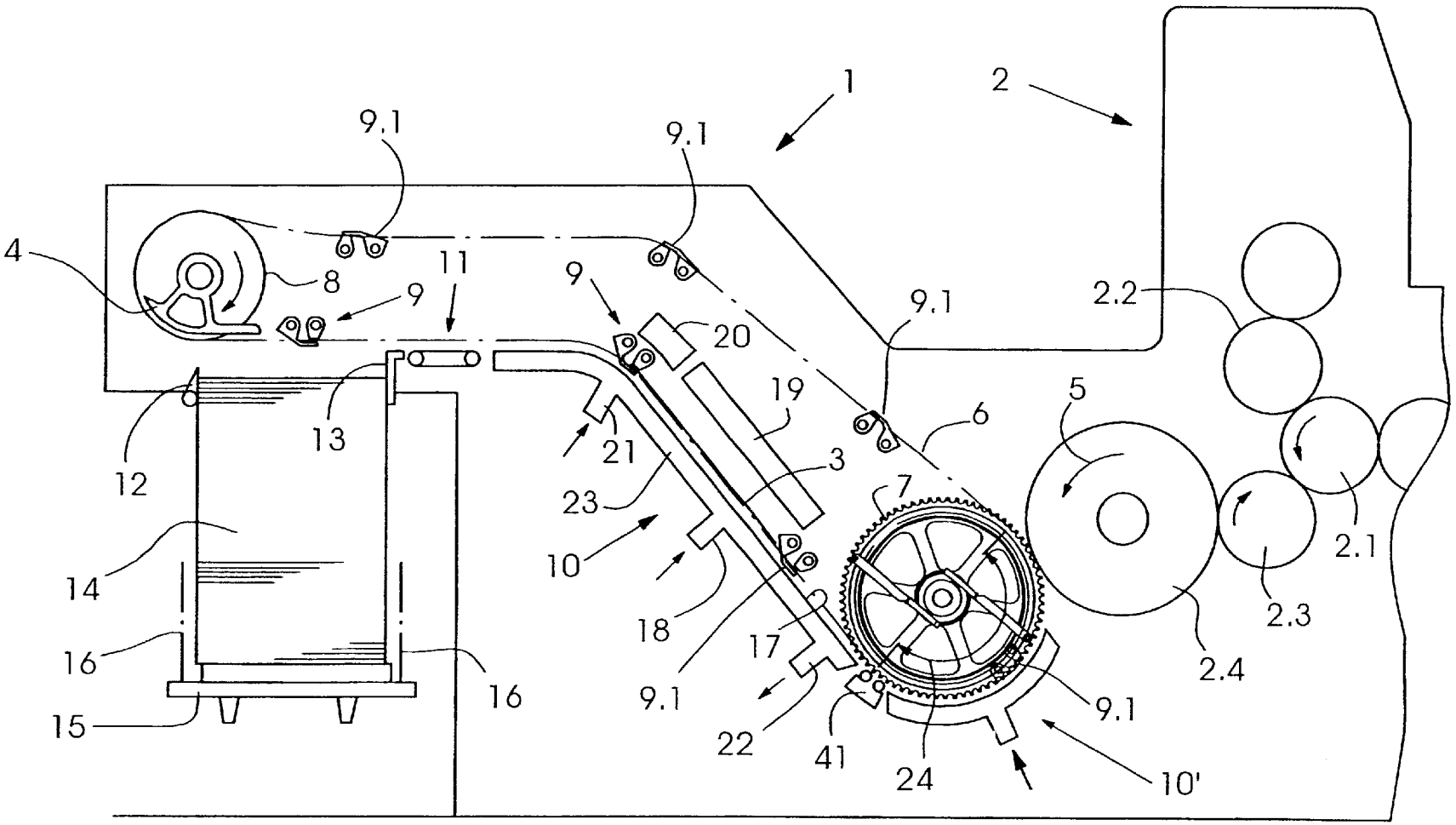
FIG. 1 is a fragmentary diagrammatic side elevational view of a sheet-processing printing machine including a delivery, an exemplary embodiment of a blast-air source forming a structural unit with a chain-wheel pair of a chain-wheel device having conveying chains wrapped therearound, the conveying chains carrying gripper bars whereon respective gripper rows are disposed.

Referring now to the drawings and, first, particularly to FIG. 1 thereof, there is shown therein a delivery 1 adjoining a final processing station of a printing machine, as viewed in the sheet-processing direction. Such a processing station may be a printing unit or a post-treatment unit, for example, a varnishing unit. In the example illustrated in FIG. 1, the last processing station is an offset printing unit 2 with an impression cylinder 2.1. The latter guides a respective sheet 3, in a processing direction indicated by an arrow 5 representing a direction of rotation, through a nip between the impression cylinder 2.1 and a blanket cylinder 2.2 cooperating therewith and, in the example of FIG. 1, then transfers it to a gripper row of a single-revolution transfer drum 2.3, the gripper row being arranged on the impression cylinder 2.1 and being openable for gripping the sheet 3 at a gripper border at the leading end of the sheet 3. A corresponding transfer of the sheet 3 then takes place from the single-revolution transfer drum 2.3 to a further transfer drum 2.4, namely, a half-revolution transfer drum 2.4 in the example at hand, which finally transfers the sheet 3 to the delivery 1. The latter includes two endless conveying chains 6, each of which, respectively, revolving, during operation, in the vicinity of a respective side wall of the delivery 1 along a continuous chain path. Each of the conveying chains, respectively, wraps around one of two synchronously driven driving chain wheels 7, respectively, having axes of rotation which are aligned with one another and, in the example of FIG. 1, is guided over deflecting chain wheels 8, respectively, which are located downline of the driving chain wheels 7, as viewed in the sheet-processing direction, with the result that a respective conveying chain 6 runs through a continuous chain path. Extending between the two conveying chains 6 are gripper bars 9 which are borne by the conveying chains 6 and have grippers 9.1 which pass through gaps between grippers arranged on the transfer drum 2.4 and, in the process, receive a respective sheet 3 by gripping the gripper border at the leading end of the sheet 3 immediately before the grippers arranged on the transfer drum 2.4 are opened, transport the sheet 3 beyond a sheet-guiding device 10 to a braking station 11 and open after the sheet 3 has been transferred to the braking station 11. In the braking station 11, the sheet 3 is braked to a depositing speed that is reduced relative to the processing speed and, after the depositing speed has been reached, the sheet 3 is finally released, with the result that a respective, then slowed-down sheet 3 finally makes contact with leading-edge stops 12 and, while being aligned at the latter and at trailing-edge stops 13, which are located opposite the leading-edge stops 12, forms a pile 14 together with preceding and/or following sheets 3, it being possible for the pile to be lowered by a lifting mechanism to the extent that the pile 14 increases. Of the lifting mechanism, only a platform 15 carrying the sheet pile 14, and lifting chains 16 carrying the platform 15 and represented in phantom are shown in FIG. 1.

Along the path of the conveying chains 6 between the driving chain wheels 7, on the one hand, and the deflecting chain wheels 8, on the other hand, the conveying chains 6 are guided by non-illustrated chain-guide rails which determine the chain paths of the chain strands. In the case at hand, the chain strand that is located predominantly at the bottom in FIG. 1 transports the sheets 3 along a conveying section that extends from the location where the sheets 3 are transferred from the transfer drum 2.4 to the delivery 1 as far as a location at which a cam 4, that is disposed in the vicinity of one of the deflecting chain wheels 8, actuates a non-illustrated roller lever that is operatively connected to the grippers 9.1, and thus opens the grippers 9.1 which had been closed under spring tension, the sheets 3 being thereby released. That portion of the chain path through which the chain strand located predominantly at the bottom runs is followed by a sheet-guiding surface 17 that is directed towards that portion of the chain path and is formed on the sheet-guiding device 10. During operation, a supporting air cushion is preferably formed between the sheet-guiding surface and the sheet 3, respectively, guided thereover. For this purpose, the sheet-guiding device 10 is provided with blast-air nozzles which open out into the sheet-guiding surface 17, those nozzles, in their entirety, being represented in FIG. 1 symbolically in the form of a stub 18.

In order to prevent the printed sheets in the sheet pile 14 from sticking to one another, a drier 19 and a powder sprayer 20 are provided along the path of the sheets 3 from the driving chain wheels 7 to the braking station 11.

In order to avoid excessive heating of the sheet-guiding surface 17 by the drier 19, a coolant circuit is integrated in the sheet-guiding device 10, the circuit being indicated symbolically in FIG. 1 by an inlet stub 21 and an outlet stub 22 on a coolant tray 23 assigned to the sheet-guiding surface 17.

In the example of FIG. 1, the conveying length or section has a horizontal portion, a branch located upline from and sloping upwardly towards the horizontal portion, and a sheet-deflecting region 24 located upline from the sloping branch and, even when the sheets are printed only on one side thereof, constituting a problematic region in as much as the sheets, without any further measures being provided, may execute uncontrolled movements which may result in smearing of freshly printed ink.

One of these measures is, for example, providing, radially outside that position of the gripper path through which the grippers 9.1 pass and namely constituting the sheet-deflecting region 24, a sheet-guiding device 10' that is activatable pneumatically and is approximately of the same extent as the sheet-deflecting region 24, as viewed in the running or travel direction of the grippers 9.1. The applicant of the instant application has previously described advantageous configurations for the sheet-guiding device 10' in U.S. Pat. No. 5,456,178, and reference may be had thereto advantageously with respect to these configurations.

Another of the mentioned measures calls for directing a blast-air curtain 24 towards the sheet 3 passing the sheet-deflecting region 24 for supporting the sheet 3. The blast-air curtain is expelled by a blast-air source 26 which, in contrast with the delivery mentioned in the introduction hereto, is not fixed in position, but rather, passes the sheet-deflecting region 24 in the same direction as do the grippers 9.1.

In the case of the aforementioned, not absolutely necessary, but preferably provided, configuration wherein the blast-air curtain 25 passes the sheet-deflecting region 24 synchronously with the grippers 9.1, a particularly straightforward construction of the sheet conveyor is achieved and, more precisely, as provided in the exemplary embodiment of FIG. 1, the blast-air source 26 forms a structural unit with the chain-wheel pair formed by the driving chain wheels 7.

Figure 2A:
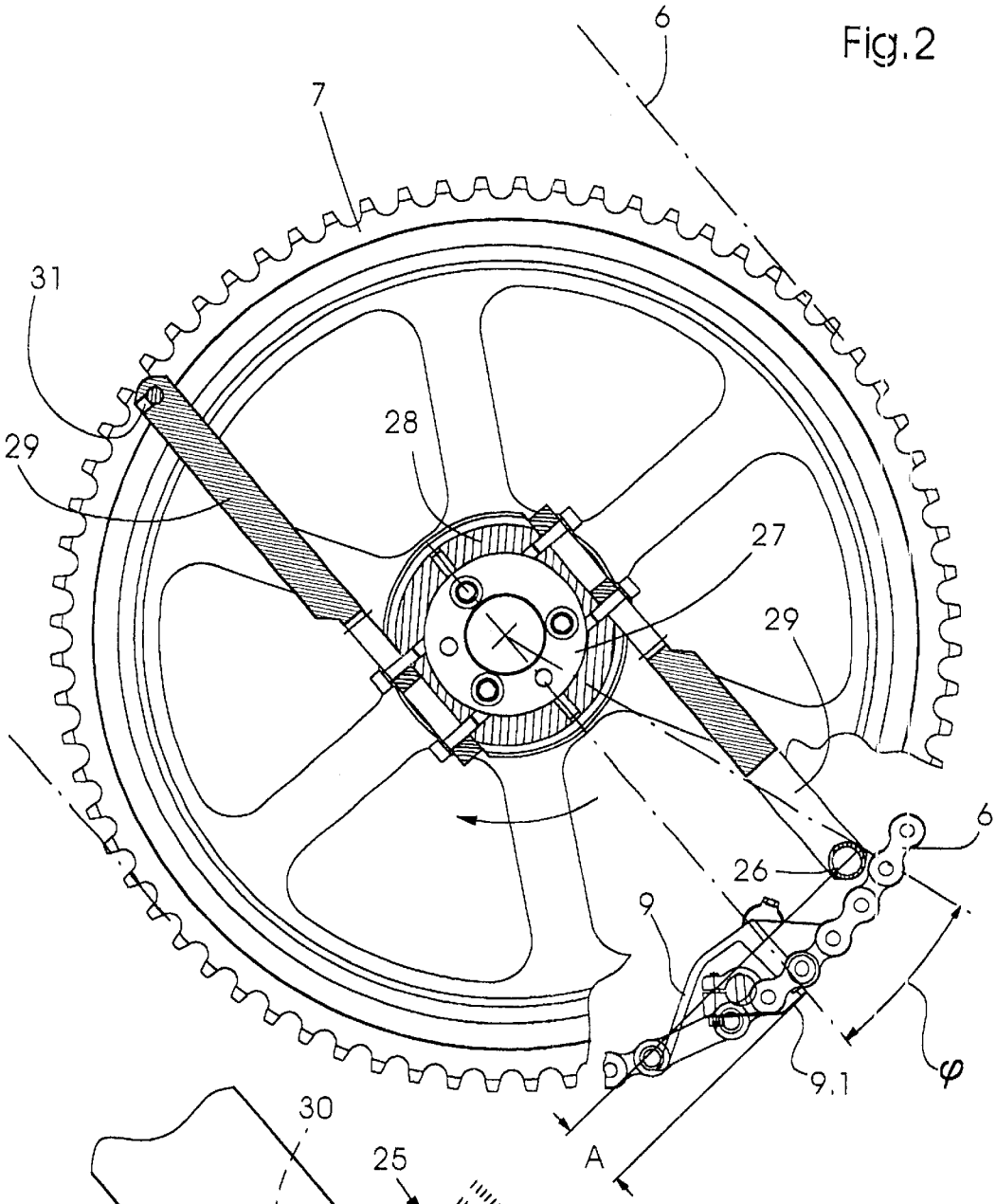
FIG. 2*a* is an enlarged fragmentary view of FIG. 2 showing a detail of the blast-air source for forming a blast-air curtain.

In this regard, the blast-air source 26 is preferably formed by the use of a tube 26.1 that is disposed parallel to the axis of rotation of the driving chain wheels 7 and has, in the longitudinal direction thereof, a row of blast-air openings 26.2, of which one opening is visible in FIG. 2*a*. The preference for a blast-air source 26 configured in such a way does not exclude the possibility of the blast-air curtain 25, which passes the sheet-deflecting region 24 as mentioned, being expelled from blast-air sources having other configurations.

Figure 2A:
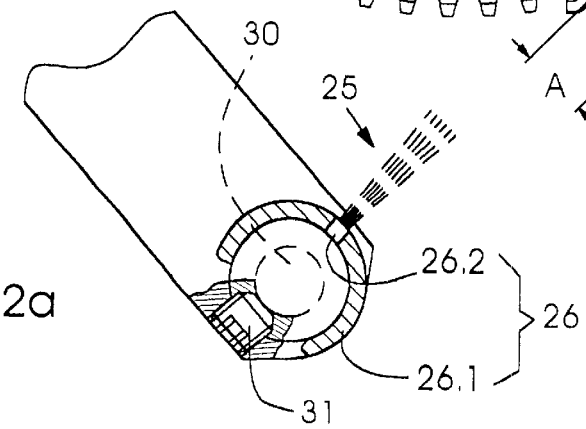
Figure 3:
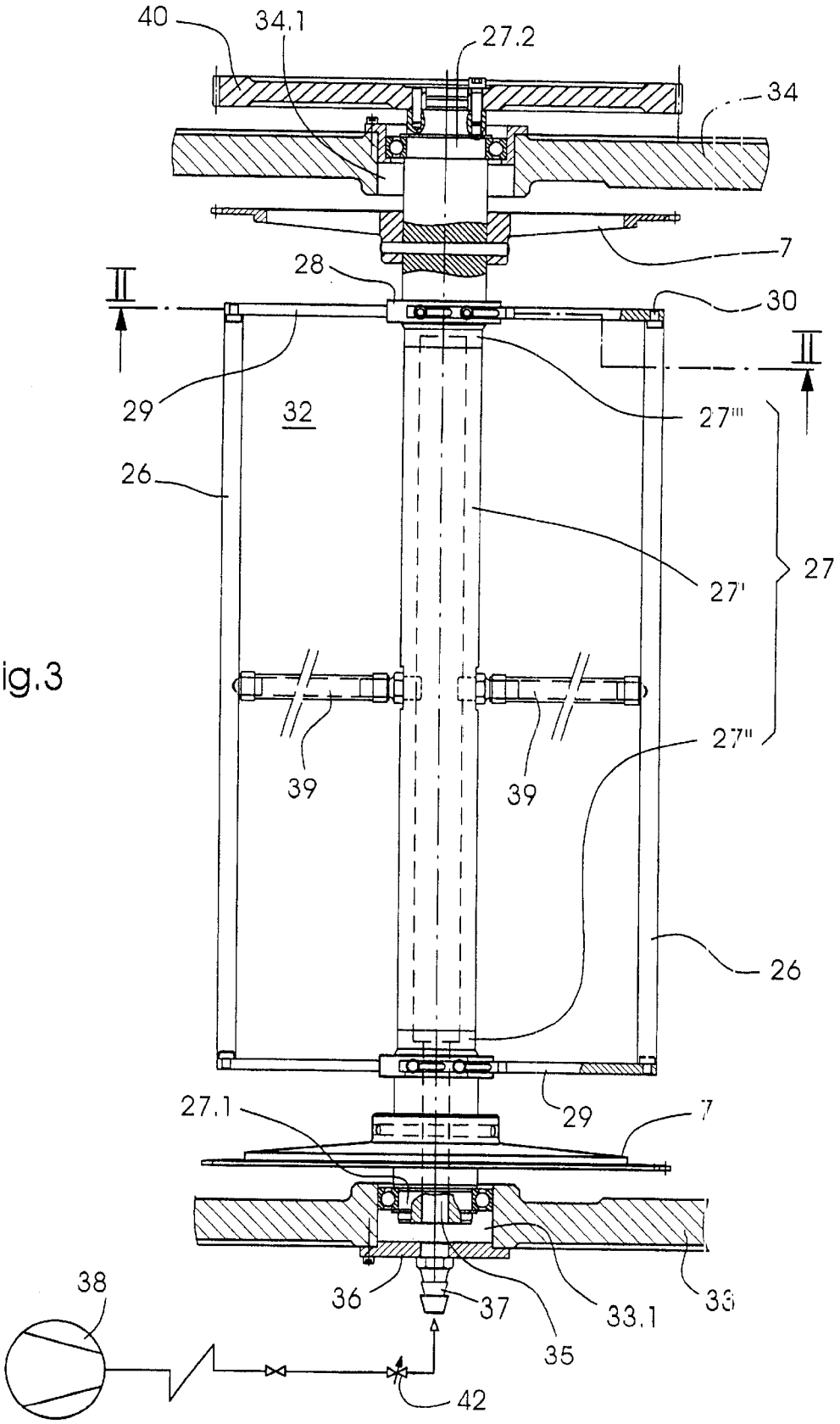
FIG. 3 is a reduced, diagrammatic and schematic top plan view of FIG. 2, showing the structural unit.

As is illustrated in FIGS. 2 and 3, the structural unit in the exemplary embodiment shown therein is constructed as follows.

The two driving chain wheels 7 are connected to a chain-wheel spindle 27 so as to be fixed against rotation relative thereto, the spindle 27 having journals 27.1 and 27.2. In the vicinity of a respective one of the chain wheels 7, the chain-wheel spindle 27 bears a respective hub 28 that is adjustable in the circumferential direction of the chain-wheel spindle 27 and is connected in a forcelocking manner thereto. In this regard, it is noted that a forcelocking connection is one which connects two elements together by force external to the elements, as opposed to a formlocking connection which is provided by the shapes of the elements themselves. Spokes 29 are fastened onto the hubs 28 so that they can be adjusted in the longitudinal direction thereof; more precisely, in the embodiment of FIGS. 2 and 3, the chain wheels 7 are half-revolution driving chain wheels 7, and two spokes 29 are fastened on each hub 28. Based upon the half-revolution construction of the driving chain wheels 7, as is apparent in FIG. 3, in particular, two blast-air sources 26 are provided, a respective one of the blast-air sources 26 being formed by a tube 26.1, in the manner explained hereinbefore. The respective tube 26.1 is closed off at the ends thereof by a respective stub 30 which projects beyond the respective tube 26.1. A respective bore formed in the respective radially outer end of the spokes 29 and extending parallel to the axis of rotation of the driving chain wheels 7 slidably receives therein one of the stubs 30, respectively. A respective tube 26.1 that is installed in this manner and is used for forming a blast-air source can thus be rotated in relation to the longitudinal axis thereof, and a given rotary position thereof is fixable by a tightening screw 31 that is inserted into at least one of the spokes bearing the tube 26.1 and that acts upon one of the stubs 30. Accordingly, the blowing direction of the blast-air curtain that is expelled, during operation, by the blast-air source 26, in this case, the tube 26.1 having a blast or blowing-nozzle row, can be adjusted, and it is preferably adjusted so that it is directed with a tendency counter to the running or travel direction of the sheets passing the sheet-deflecting region 24.

The structural unit described thus far, which includes the blast-air source 26 and the driving chain wheels 7, forms a drum body 32 which is received rotatably by the journals 27.1 and 27.2, respectively, in bearing bores 33.1 and 34.1 provided in side walls 33 and 34 of the sheet conveyor 1. The chain-wheel spindle 27 is of hollow construction so that a cavity 35 which communicates with the bearing bore 33.1 is formed in the journal 27.1. This is realized in the example or embodiment shown in FIG. 3, by the chain-wheel spindle 2 being formed as a tube 27' with respective spindle portions 27" and 27"' welded onto the ends of the tube 27', the spindle portion 27" being formed with a through-passage bore opening into the tube 27' and forming the cavity 35.

The journal 27.1 projects into the bearing bore 33.1 only over part of the depth of that bearing bore 33.1, and the end of the bearing bore 33.1 that is directed away from the chain-wheel spindle 27 is closed off by a cover 36 that has a connection nipple 37 via which the bearing bore 33.1 can be connected to a compressed-air generator 38.

Between a respective tube 26.1, provided for forming the respective blast-air source 26, and the tube 27' of the chain-wheel spindle 27, a connection is produced by flexible lines 39, with the result that, ultimately, a respective blast-air source 26 communicates with the cavity 35.

This allows the revolving blast-air sources 26 to be supplied with compressed air without requiring any rotary lead-through.

Because the spokes 29, which carry a respective blast-air source 26, are fastened onto the hubs 28 so that they can be adjusted in the longitudinal direction thereof, the blast-air curtain 25 can pass the sheet-deflecting region 24 at an adjustable distance A (note FIG. 2) from the conveying section.

Because the tubes 26.1, which form the blast-air sources 26, are carried, via the spokes 29, by the hubs 28, which are connected to the chain-wheel spindle 27 so that they can be adjusted in circumferential direction, the blast-air curtain 25 can pass the sheet-deflection region 24 at an adjustable phase angle $\phi$ (note FIG. 2) relative to the grippers 9.1.

The grippers 9.1, for their part, pass the sheet-deflecting region 24 during operational rotation of the drum body 32, which includes, in particular, the driving chain wheels 37 having, wrapped around them, the conveying chains 6, which carry the gripper bars 9.

For the operational rotation of the drum body 32, the chain-wheel spindle 27, in the exemplary embodiment shown in FIG. 3, is connected, so as to be fixed against rotation relative thereto, to a driving gear wheel 40 that forms a constituent part of a gear train connected to a drive system.

As is explained hereinbelow, the delivery which has been described thus far has also proven to be particularly advantageous for further reasons.

As is indicated in FIG. 1, the sheet-guiding device 10 is preceded by a sheet decurler 41 that is usually used in the case of sheets which have been printed on one side thereof, and in the case at hand, on that side of the sheet that is directed away from the sheet-guiding device 10 and, in this regard, by a negative pressure in a decurling nip perpendicular to the side edges of the sheets, which draws the sheets into the decurling nip. However, the negative pressure is fully effective in this sense only when the respective sheet has positioned itself in contact with the sheet decurler 41. Because the latter is usually arranged in close proximity to the outlet region of the sheet-deflecting region, the operation wherein the sheet 3 positions itself against or in contact with the sheet decurler 41 is aided by the blast-air curtain 25 passing the sheet-deflecting region 24.

Furthermore, the preferred configuration of the blast-air source 26 in the form of the tube 26.1 carried by the spokes 29 provides the advantages of good accessibility to the sheet-deflecting region 24 for cleaning purposes and of a good view into the sheet-deflecting region 24 which, particularly in the case of sheets which are printed on both sides, is extremely helpful for adjusting the pneumatically activatable sheet-guiding device 10'.

Furthermore, the adjustability of the blast-air source 26 with respect to the following parameters: the blowing or blast direction of the blast-air curtain 25, the distance of the blast-air source 26 from the conveying section in the sheet-deflecting region 24 and the phase angle $\phi$ of the blast-air source 26 relative to the grippers 9.1 passing the sheet-deflecting region 24, allow the spatial position of the blast-air curtain 25 to be adjusted in relation to the drum body 32 so that a compromise is achieved in terms of the effect of the blast-air curtain 25 on sheets with different grammage and different degrees of rigidity or stiffness. Of course, it is also possible to maintain just individual ones of the foregoing parameters for a number of different print jobs.

A further possible way of influencing the effect of the blast-air curtain is to change the pressure of the compressed air fed to the blast-air source 26. This is indicated in FIG. 3 by the adjustable throttle 42.

Figure 4:
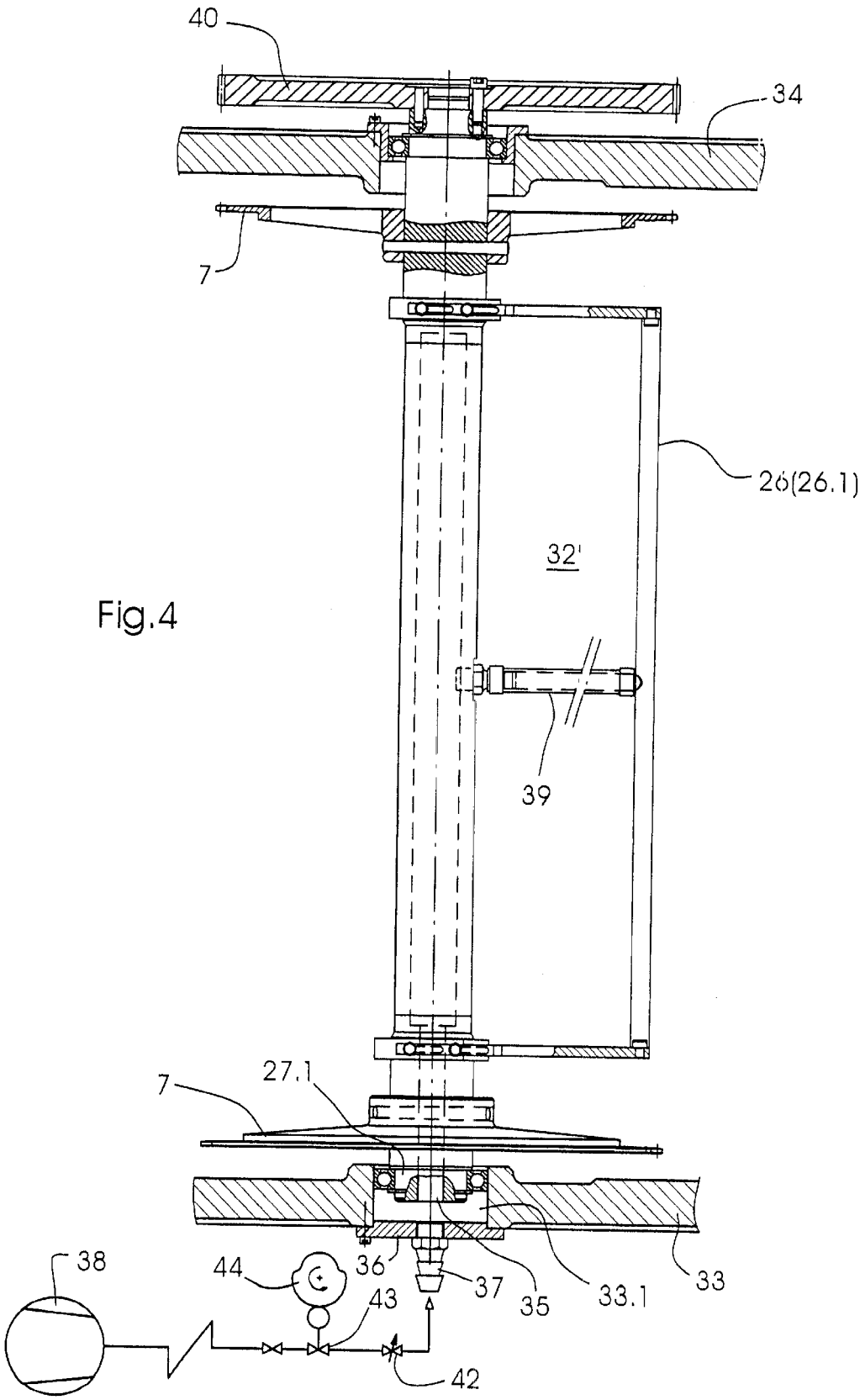
FIG. 4 is a view like that of FIG. 3 of another embodiment of the structural unit that has been modified for the case of a single-revolution blast-air curtain.

FIG. 4 illustrates an exemplary embodiment for expelling the blast-air curtain 25 cyclically from the blast-air source 26, more precisely, using the example of a structural unit that includes the blast-air source 26 and the two driving chain wheels 7 in the form of a drum body 32' which, although it is the same in principle as the drum body 32 according to FIG. 3, differs from the latter in that the drum body according to FIG. 3 is a half-revolution drum body, and the drum body according to FIG. 4 is a single-revolution drum body, and thus has merely one tube 26.1 constituting the blast-air source 26. In order to realize the cyclic expulsion, the bearing bore 33.1 corresponding to the exemplary embodiment according to FIG. 3 can be connected to the compressed-air generator 38 via an on/off valve 43 which, in this case, is alternately opened and closed, by way of example, mechanically by a cam 44 which, during operation, rotates synchronously with the drum body 32'. In this case, the phase position of the cam 44 relative to the drum body 32' is adjusted so that the on/off valve 43 is open when the blast-air source 26 passes the sheet-deflecting region 24.

An operation wherein the tubes 26.1 provided for forming the half-revolution drum body 32 according to FIG. 3 are subjected to the action of compressed air in a corresponding, but alternating, cyclic manner is realized in an analogous manner and with a modification of the drum body 32 and the connection thereof to the compressed-air generator 38, which has the effect that the two tubes 26.1, which expel a blast-air curtain 25 during operation, can be connected to the compressed-air generator 38 independently of one another.

I claim:

1. A delivery of a sheet-processing machine having a conveying section with endless converying chains, the sheets each having a respective leading edge, and gripper rows for drawing sheets, during operation, along the conveying section in a running direction, said endless conveying chains bearing the gripper rows and, during operation, running through the delivery in a revolving direction, and having a pair of chain wheels which are rotatable about a common axis of rotation, are in engagement with the conveying chains, and form a deflecting region of the conveying section, the delivery comprising:

a blast-air source expelling an air curtain meeting the leading edge of each respective sheet and acting upon a side of the sheets being drawn past the sheet-deflecting region, the side being directed towards the axis of rotation of the chain wheels, said air curtain being movable with the chain wheel past the sheet-deflecting region in the same direction as the grippers, while the sheets passing the sheet-deflecting region are being subjected to the action of said air curtain; said air curtain blowing in a blowing direction, and said blowing direction being counter to the running direction.

2. The delivery according to claim 1, wherein said air curtain is movable past the sheet-deflecting region synchronously with the grippers.

3. The delivery according to claim 1, wherein the sheet-processing machine is a printing machine.

4. The delivery according to claim 1, wherein said blowing direction of said air curtain is adjustable.

5. The delivery according to claim 1, wherein said air curtain is movable past the sheet-deflecting region at an adjustable distance from the conveying section.

6. The delivery according to claim 1, wherein said air curtain is movable past the sheet-deflecting region at an adjustable phase angle relative to the grippers.

7. The delivery according to claim 1, including:

a side wall having a bearing bore;

a journal formed with a cavity received by said bearing bore;

a drum body carrying said blast-air source, said blast-air source communicating with said cavity, said cavity communicating with said bearing bore, and said bearing bore being connectable to a compressed-air generator.

8. The delivery according to claim 1, wherein said blast-air source is capable of expelling said air curtain cyclically.

9. A sheet-processing printing machine, comprising a delivery according to claim 1.

* * * * *